United States Patent [19]

Ogawa et al.

[11] Patent Number: 4,830,845

[45] Date of Patent: May 16, 1989

[54] PRECURSOR FOR PRODUCTION OF PREOXIDIZED FIBERS OR CARBON FIBERS

[75] Inventors: Hiroyasu Ogawa; Tetsuro Shigei, both of Shizuoka, Japan

[73] Assignee: Toho Belson Co., Ltd., Tokyo, Japan

[21] Appl. No.: 789,243

[22] Filed: Oct. 18, 1985

[30] Foreign Application Priority Data

Oct. 19, 1984 [JP] Japan ..... 59-218507

[51] Int. Cl.[4] ..... D01C 5/00; D01F 9/12; B05D 3/02

[52] U.S. Cl. ..... 423/447.2; 423/447.4; 427/387; 428/394; 8/115.6; 252/8.6

[58] Field of Search ..... 8/115.6; 264/29.6, 29.2, 264/29.1; 423/447.2, 447.4, 447.6; 252/8.6; 427/387, 394

[56] References Cited

U.S. PATENT DOCUMENTS

| | | | |
|---|---|---|---|
| 4,009,248 | 2/1977 | Kishimoto et al. | 423/447.4 |
| 4,080,417 | 3/1978 | Kishimoto et al. | 264/29.2 |
| 4,409,267 | 10/1986 | Ichinohe et al. | 427/387 |

FOREIGN PATENT DOCUMENTS

| | | |
|---|---|---|
| 0100826 | 2/1984 | European Pat. Off. . |
| 52-148227 | 9/1977 | Japan . |
| 59-179885 | 10/1984 | Japan . |
| 2090302 | 12/1980 | United Kingdom . |

OTHER PUBLICATIONS

*Chemical Abstracts,* vol. 102, No. 4, Jan. 28, 1985, p. 87, No. 26295z.

*Primary Examiner*—Paul Lieberman
*Assistant Examiner*—John F. McNally
*Attorney, Agent, or Firm*—Sughrue, Mion, Zinn, Macpeak, and Seas

[57] ABSTRACT

An acrylic fiber having applied thereto a polyoxyalkylene aminopolysiloxane compound having a viscosity of from 5 to 500 poises at 25° C. and which is represented by formula (I) as an oiling agent:

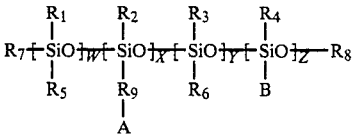

(I)

wherein $R_1$, $R_2$, $R_3$, $R_4$, $R_5$, and $R_6$ each represents a lower alkyl group or an aryl group, $R_7$ represents a hydrogen atom, a lower alkyl group or an aryl group, $R_8$ represents H or $-CH_3$, or

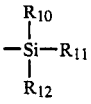

(wherein $R_{10}$, $R_{11}$ and $R_{12}$ each represents a hydrogen atom, a lower alkyl group or an aryl group), $R_9$ represents an alkylene group having not more than 5 carbon atoms, an arylene group, or a single bond, A represents a group

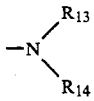

(wherein $R_{13}$ and $R_{14}$ each represents H, $-CH_3$, $-C_2H_5$),

B represents a group

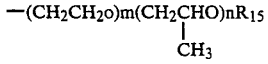

(wherein $R_{15}$: H or $-CH_3$, and m and n each represents 0 or an integer of from 1 to 10, provided that $m+n \geqq 1$), X and Z each represents an integer from 1 or more, and W and Y each represents 0 or an integer of 1 or more.

29 Claims, No Drawings

PRECURSOR FOR PRODUCTION OF PREOXIDIZED FIBERS OR CARBON FIBERS

BACKGROUND OF THE INVENTION

The present invention relates to acrylic fiber which is used for production of preoxidized fiber or carbon fiber (including graphite fiber). Hereunder such acrylic fiber is referred to as a acrylic fiber precursor.

In order to produce high-strength carbon (including graphite) fibers from an acrylic fiber precursor, it be generally required that the precursor be preoxidized in an oxidizing atmosphere at 200°-300° C., followed by the carbonization (or graphitization) of the prexidized precursor in an inert gas atomsphere such as nitrogen gas atmosphere, at a temperature of 500° C. or higher (these methods are disclosed, for example in U.S. Pat. Nos. 4,069,297; 4,543,241 and 4,536,448). In this instance, it is important that the filaments of the fiber strand being preoxidized at 200°-300° C. are prevented from coalescing to each other. In order to meet this requirement it has been proposed that a variety of silicone-based oiling agents are applied to the filaments during the process of production of an acrylic fiber precursor. Generally, filaments are produced by extruding a soulution of an acrylic polymer in an organic or inorganic solvent into a coagulating bath. It has been proposed to apply a silicone based oiling agent to fiber after washing and stretching the spun filaments or after drying the fiber to increase the density of the filaments. It has also been known to apply an aminopolysiloxane-based oiling agent (Japanese Patent Publication Nos. 24136/77 and 10175/78) or a polyoxyalkylenepolysiloxane-based oiling agent to acrylic fiber (Japanese Patent Application (OPI) No. 148227/77) ("OPI" as used herein means a "published unexamined Japanese patent Application).

However, the use of an aminopolysiloxane-based oiling agent is not completely effective in preventing coalescence of the filaments during the preoxidation step. Furthermore, the agents tend to promote, rather than suppress, the breakage of filaments in the step of production of the precursor. A polyoxyalkylenepolysiloxane-based oiling agent tends to penetrate into the filaments upon preoxidation, whereby the formation of voids or other defects on the surface layer or the interior of the filament during the subsequent carbonization increases. These defects decrease, rather than increase, the strength of the preoxidized fiber or carbon fibers. In order to avoid these problems, a method of using a polyoxyalkylene-polysiloxane-based oiling agent in combination with an aminopolysiloxane-based oiling agent has been proposed, but even by this method the defects inherent in the individual oiling agents can not be completely eliminated, and therefore fully satisfactory high-strength carbon fibers have not yet been obtained.

SUMMARY OF THE INVENTION

The present invention has been accomplished as a result of extensive studies made by the present inventors in order to solve the problems associated with the prior-art techniques described above.

An object, of the present invention is to provide an acrylic fiber precursor which does not cause coalescence of filaments during preoxidation, and which does not cause voids or other defects in the fialments when it is subjected to preoxidation or carbonization.

Another object of the present invention is to provide an acrylic fiber precursor that is capable of producing carbon fibers having a strength of 500 kg/mm$^2$ or higher.

A further object of the present invention is to provide an acrylic fiber precursor that minimizes breakage of filaments.

The present invention provides acrylic fiber having applied a polyoxyalkylene-aminopolysiloxane compound that has a viscosity of from 5 to 500 poises at 25° C. and which is represented by formula (I) as an oiling agent:

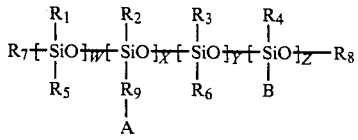

(I)

wherein $R_1$, $R_2$, $R_3$, $R_4$, $R_5$, and $R_6$ each represents a lower alkyl group or an aryl group, $R_7$ represents a hydrogen atom, a lower alkyl group or an aryl group.

$R_8$ represents H or —$CH_3$, or

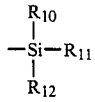

(wherein $R_{10}$, $R_{11}$ and $R_{12}$ each represents a hydrogen atom, a lower alkyl group or an aryl group), $R_9$ represents an alkylene group having not more than 5 carbon atoms, an arylene group, or a single bond, A represents a group

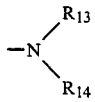

(wherein $R_{13}$ and $R_{14}$ each represents H, —$CH_3$, —$C_2H_5$),

B represents a group

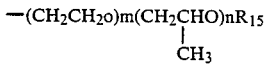

(wherein $R_{15}$: H or —$CH_3$, and m and n each represents 0 or an integer of from 1 to 10, provided that $m+n \geqq 1$), X and Z each represents an integer from 1 or more, and W and Y each represents 0 or an integer of 1 or more.

DETAILED DESCRIPTION OF THE PRESENT INVENTION

The lower alkyl group in the formula (I) preferably is an alkyl group having from 1 to 4 carbon atoms, and it may be a straight chain or branched chain alkyl group, and preferably a straight chain. The aryl or arylene group in the formula (I) is preferably a phenyl group or a phenylene group, respectively.

The acrylic fiber precursor of the present invention is preferably having applied with a polyoxyalkylene aminopolysiloxane compound of formula (I) wherein (a) the amino group (A) in a side chain accounts for from 0.5 to 1.5% by weight of the molecule, (b) the polyoxyalkylene group (B) in the side chain accounts for from 5 to 15% by weight of the molecule, or wherein both groups (A) and (B) satisfy the respective requirements (a) and (b).

X and Z in the formula (I) is determined depending on the amounts of the amino group (A) and the polyoxyalkylene group (B) in the molecule, respectively, and W and Z is determined depending on the necessary viscosity of the oiling agent.

The acrylic fiber precursor of the present invention is produced from an acrylonitrile homopolymer or a copolymer preferably containing not less than 90% by weight of acrylonitrile. Known compounds can be used as comonomers with acrylonitrile. Examples for comonomers include acrylic acid, methyl and ethyl esters thereof, salts thereof (e.g., Na, K or $NH_4$ salts), acrylamide, itaconic acid, methacrylic aid, methallylsufonic acid, allylsulfonic acid, and alkali metal salts (e.g., Na or K salts) and ammonium salts thereof. These acid and salt comonomers are preferably used in amounts ranging from 0.3 to 7% more preferably 0.3 to 5% by weight of the copolymer.

Acrylic fiber used in the present invention is productd by a conventional method. For example, it is produced as follows;

The acrylonitrile homopolymer or copolymer described above is dissolved in any of known solvents such as dimethylformamide, dimethylacetamide, zinc chloride, thiocyanate, nitric acid, and dimethyl sulfoxide to obtain from about 5 to 30 wt% solution; the resulting solution is extruded through a nozzle having 500 to 100,000 small holes into a coagulating bath (i.e., of a dilute solvent solution) either directly or through air; the spun filaments are washed with water to remove the solvent while they are streched at a draw ratio of from 2 to 5. Fibers thus obtained are dried to increase their density, and then stretched at a draw ratio of from 2 to 10 in saturated steam at from 100° to 160° C., thereby producing an acrylic fiber having a filament fineness of from 0.1 to 2 deniers.

The oiling agent is applied to acrylic fiber, preferable, after the washing (prior to the drying) or after the drying (prior to the stretching in steam). It is especially preferably to apply the agent after the washing.

The polysiloxane compound used in the present invention is a compound prepared preferably either by subjecting polysiloxane to amino modification and polyoxyalkylene modification, or by reacting aminopolysiloxane with polyoxyalkylene polysiloxane.

For example, the polyoxyalkylene aminopolysiloxane can be produced by adding an alkylene oxide to an aminopolysiloxane under the presence of an alkaline catalyst, and then reacting them under heating (e.g., at about 120° C.) to produce a polyoxyalkylene aminopolysiloxane.

The compound is characterized by containing both amino group and polyoxyalkylene groups in its molecules. Preferably, the polysiloxane compound contains from 0.5 to 1.5% by weight and from 5 to 15% by weight, respectively, of the amino group (A) and the polyalkylene group (B) of formula (I). More preferably, the polysiloxane compound contains from 0.7 to 1.2% by weight of group (A) and from 7 to 13% by weight of group (B). When the compound has the proportion of group (A) in formula (I) of less than 0.5% by weight, uniform deposition of the polysiloxane compound on the fibers is difficult, and uniform preoxidation of the resulting fiber will be also difficult. When such fiber is carbonized, the unevenness of the deposition of the polysiloxane compound will makes obtaining of high-strength carbon fibers difficult. When the proportion of group (A) exceeds 1.5% by weight, the filaments cannot be effectively prevented from coalescing upon preoxidation, and considerable difficulty is involved in producing high-strength carbon fibers. When the content of group (B) of formula (I) is less than 5% by weight, the polysiloxane compound will also deposites unevenly onto the fibers, and the eventual carbon fiber generally has low strength. When the content of group (B) exceeds 15% by weight the amount of polysiloxane compound which penetrates into the interior of the fiber increases and introduces defects to the filaments upon carbonization, thereby making it difficult to obtain high-strength carbon fibers.

The polysiloxane compound most preferred for use in the present invention is a polyoxyalkylene aminopolysiloxane compound having from 0.5 to 1.5% by weight of the amino group (A) and from 5 to 15% by weight of the polyoxyalkylene group (B) in the compound.

Each of the groups $R_1$,$R_2$,$R_3$,$R_4$,$R_5$, and $R_6$ in formula (I) is preferably a methyl or ethyl group; $R_7$ and $R_8$ each is preferably a hydrogen atom or a methyl group, with the latter being more preferable; the group represented by (A) is preferably an amino group (—$NH_2$), a dimethylamino group, or diethylamino group; and $R_9$ preferably is a methylene group or an ethylene in combination with (A) which is an amino group (—$NH_2$); the polyoxyalkylene group (B) is either an polyoxyethylene group or a polyoxypropylene group, or a group formed by the block polymerization of oxyethylene and oxypropylene groups; the sum of m and n is preferabley no more than 10; becausse, when the sum of m and n is more than 10, the polysiloxane compound tends penetrate into the interior of the fillaments upon preoxidation and introduce defects that are detrimental to subsequent carbonization, thereby making it difficult to obtain high-strength carbon fibers.

The polyoxyalkylene aminopolysiloxane compound used in the present invention has a viscosity of from 5 to 500 poises at 25° C. When the viscosity of this compound is less than 5 poises, it tends to penetrate the interior of the fibers and to defects to the filaments upon carbonization. If its viscosity exceeds 500 poises, the compound is less effective in preventing the coalescence of the filaments of the fiber strand. The preferred viscosity range is from 100 to 300 poises.

The polyoxyalkylene-aminopolysiloxane compound is applied to filaments during the process of the production of acrylic fibers preferably in an amount of not less than 0.01% by weight, more preferably from 0.05 to 10% by weight, based on the weight of the fiber having the compound.

Preferred method for the application of the polyoxyalkylene aminopolysiloxane compound are described hereunder.

Acrylic fiber filaments are immersed in 0.1–10% by weight aqueous solution or dispersion of the polysiloxane compound through either rollers or guide members. Alternatively, the same aqueous solution or dispersion may be sprayed onto the acrylic fiber filaments. The appropriate temperature of the aqueous solution or dispersion of the polysiloxane compound is within the range of from 15° to 50° C. Temperatures above 50° C. is not prefered because the polysiloxane compound tends to penetrate into the interior of the fibers. The appropriate period of time for immersion of the acrylic fiber in the aqueous solution or dispersion of the polysiloxane compound is from from 1 to 100 seconds. A period of from 1 to 10 seconds is preferred if the immersion is conducted after the solvent for spinning is removed from the fiber by washing, and a period of from 10 to 40 seconds is preferred if the immersion is conducted for dried and densified filaments.

After removing the solvent from filaments by washing, the filaments (either having the oiling agent or having no oiling agent) are preferably dried in two stages, the first stage consisting of heating at from 70° to 90° C. for from 30 to 120 seconds until the moisture content of the filaments is reduced to from 5 to 10% by weight based on the weight of the filaments, and the second stage consisting of heating at from 120° to 140° C. to attain a moisture content of 1% or less. When the compound is applied to the fiber after the drying, the fiber is not necessary to subject to further drying.

The polyoxyalkylene aminopolysiloxane compound of the present invention may be used in combination with a conventional oiling agent such as an aliphatic polyoxyalkylene compound or a quaternary ammonium salt thereof or a compound represented by formula (II), (III) (which are disclosed in U.S. Pat. No. 4,536,448) or (IV) shown hereinbelow. If used combined in this way, the proportion of the polyoxyalkylene aminopolysiloxane compound is preferably at least 20%, more preferably at least 30% by weight based on the total weight of oiling agent.

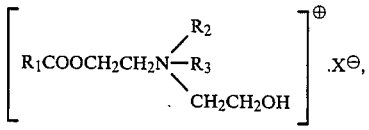

(II)

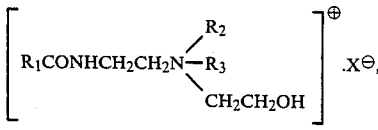

(III)

In these formulae, $R_1$ is an aliphatic hydrocarbon group having from 11 to 17 carbon atoms, and preferably is a linear saturated aliphatic hydrocarbon group; $R_2$ and $R_3$ are hydrogen, a lower alkyl group preferably having from 1 to 3 carbon atoms such as methyl and ethyl groups, hydroxyethyl group and hydroxyisopropyl group; and X is an anion, such as chlorine ion, acetate ion, lactate ion, phosphate ion, sulfate ion, borate ion, nitrate ion, and phosphoryl dioxy ethanol ion, or chlorine.

The ammonium salts of these formulae can be used alone or in combination of two or more of these ammonium salts for the treatement of the acrylonitrile fiber. An ammonium salt of fatty ester and an ammonium salt of fatty amide may be combined.

Examples of the compound represented by formula (II) are listed below.

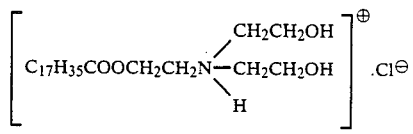

(1)

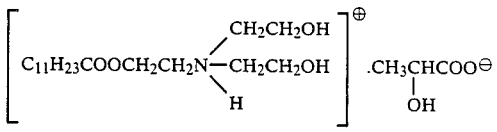

(2)

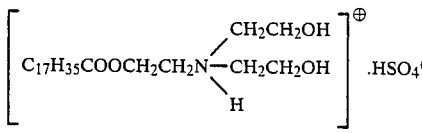

(3)

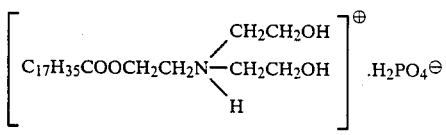

(4)

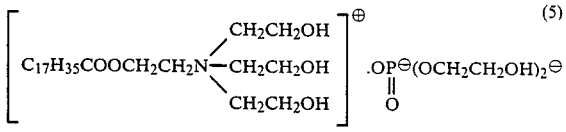

(5)

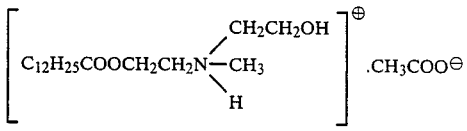

(6)

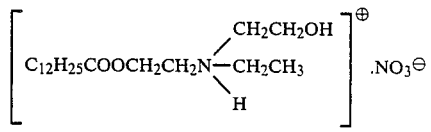

(7)

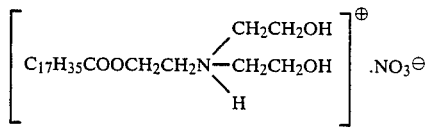

(8)

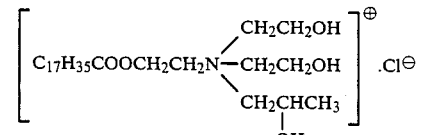

(9)

Examples of the compound represented by the formula (III) are listed below.

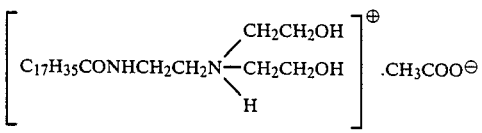

(1)

-continued

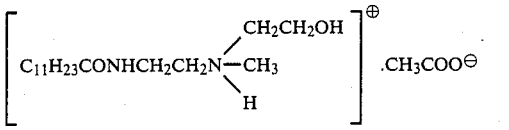

(2)

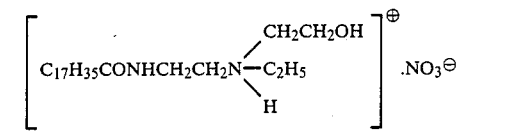

(3)

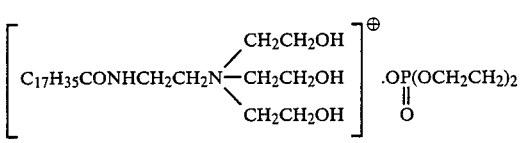

(4)

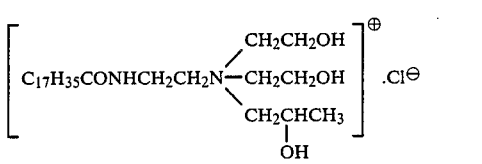

(5)

$C_nH_{2n+1}COO(CH_2CH_2O)_pH$ (IV)

wherein n is from 9 to 18 and p is from 10 to 50.

The acrylic fiber precursor of the present invention obtained in the method described hereinabove usually consists of a strand of from about 500 to 100,000 filaments that have tensile strength of more than about 5 g/denier, a dry elongation of more than about 5%, and a fineness of from 0.1 to 2 deniers.

The oiling agent of the present is preferably deposited only on the surface of the acrylic fiber. Howver, it is thought that impregnation of some oiling agents of the present invention can not be prevented completely. Even if the oiling agent permeates into the fiber the amount is considered to be very small because when the oiling agent of the present invention is used preoxidized fiber and carbon fiber having higher mechanical strength than those of fibers produced using a conventional oiling agent.

The acrylic fiber treated with a oiling agent is subjected to the process for preoxidation. The process for preoxidation is carried out by a known conventional method. For instances, the acrylic fiber is heated at a temperature from 200° C. to 300° C., and preferably from 250° C. to 300° C., in an oxidizing atmosphere for from 0.1 to 15 hours. In a conventional preoxidation method the rate for raising the temperature of the fiber is not specifically controlled, and therefore the temperature of the fiber is typically increased in a rate more than about 25° C./sec. This oxidation treatment is preferably performed under a tension of from 100 to 200 mg/denier to obtain high-strength carbon fiber. The tension is usually increased to 250 mg/denier if it is desirable to obtain carbon fiber of much higher strength. The carbonization treatment is preferably performed until the specific gravity of the fiber becomes from 1.30 to 1.40 g/cm$^3$.

The preoxidized fiber thus-obtained has very little coalescence and is suitable for producing high-strength carbon fiber by carbonization.

The carbonization process for the preoxidized fiber is usually performed at from 1000° C. to 1500° C. in an inert atmosphere such as nitrogen, argon, or helium and preferably while under a tension of from 100 to 250 mg/denier.

The acrylic fiber precursor of the present invention has the advantage that the consistent production of preoxidized fiber or carbon fiber having good mechanical properties is ensured, without any coalescence of the filaments during preoxidation or carbonization, and without any defects introduced to either the surface layer or interior of the fibers.

The carbon fibers prepared from the acrylic fiber precursor of the present invention have an extremely high tensile strength, such as 500 kg/mm$^2$ or higher. Carbon fibers having such high tensile strengths can be used as structural materials which provide enhanced performance in sports goods, aircraft and space rocket materials.

The following examples are provided to further illustrate the advantages of the present invention. In these examples, all percentages and parts are by weight unless otherwise indicated.

EXAMPLE 1

A polymer solution was prepared by dissolving a copolymer (mol.wt.:55,000) of 95% acrylonitrile, 4.5% methyl acrylate, and 0.5% itaconic acid in a 60% aqueous solution of zinc chloride to provide a polymer concentration of 10% and a viscosity of 70 poises (at 45° C.). The polymer solution was held at 40° C., and extruded into a 30% aqueous solution of zinc chloride (10° C.) through a nozzle (0.045 mm$^{\phi}$ × 12,000 holes) at a draft ratio [(speed of take up roller/linear speed of extrusion) × 100] of 25%. The extruded filaments were successively passed through washing baths at 15° C., 30° C., 50° C. and 75° C. so as to remove the solvent, while the filaments were stretched at a draw ratio of 2.5.

The filaments were then immersed in a oiling bath for 5 seconds. The oiling bath was prepared by dissolving in warm water (at 35° C.) 10 g/1,000 ml of a polyoxyalkylene aminopolysiloxane compound of formula (I) wherein $R_1$,$R_2$,$R_3$,$R_4$,$R_5$,$R_6$,$R_7$ and $R_8$ each represent —$CH_3$; $R_{13}$,$R_{14}$, and $R_{15}$ represent H; $R_9$ represents —$CH_2$—; m is 8; n is 0; and the proportions of the polyoxyethylene group [$(CH_2CH_2O)_8H$] and the amino group (—$NH_2$) in the molecule were 10% and 0.8% respectively; and which had a viscosity of 190 poises at 25° C. After the immersion, the filaments were dried by heating at 80° C. for 100 seonds, followed by heating at 125° C. for 100 seconds to reduce their moisture content to 1% or less. The dried filaments were then stretched at a draw ratio of 5.0 in saturated steam at 115° C., to obtain a strand of 12,000 filaments with filament size of 0.5 denier.

The filaments in the thus obtained acrylic fiber precursor had a tensile strength of 7.5 g/denier, an elongation of 8% and the amount of deposition of 0.1% of the polyoxyalkylene aminopolysiloxane compound which was uniformly deposited, and were entirely free of the problem of coalescence.

This acrylic fiber precursor was preoxidized in a oven in air at 250° C. under a tension of 100 mg/denier for period of 90 minutes, followed by carbonization in a furnace in a nitrogen stream at 1,500° C. under a tension of 100 mg/d for a period of 1 minute. These treatments produced a strand of high-strength carbon fibers (tensile strength: 550 kg/mm$^2$, modulus of elasticity: 30 × 10$^3$ kg/mm$^2$, elongation: 1.83%). Microscopic observation of the carbon fibers showed that, of the 12,000 filaments, only 10 blocks each consisting of 2 or 3 coalesced filaments were produced.

EXAMPLE 2

Four samples of acrylic fiber precursor strand were prepared as described in Example 1, using a polyoxyethylene aminopolysiloxane compound having the same $R_1$, $R_2$, $R_3$, $R_4$, $R_5$, $R_6$, $R_7$, $R_8$, $R_9$, $R_{13}$, $R_{14}$ and $R_{15}$ as that of Example 1, and wherein the proportion of polyoxyethylene group (B) in the polyoxyethylene aminopolysiloxane compound 3%, 8%, 12%, or 20%, respectively, and the amino group (A) was 1.2%. Each of the polyoxyethyleneaminopolysiloxane compounds used had a viscosity of 300 poises at 25° C.

Carbon fibers were produced from the four samples of acrylic fiber precursor by preoxidizing them in air at 255° C. under a tension of 120 mg/denier for 60 minutes, then carbonizing the preoxidized fibers in a nitrogen gas at 1,150° C. under a tension of 120 mg/denier for 2 minutes. The performances of each of the acrylic fiber precursors and the carbon fibers produced therefrom is shown in Table 1, from which one can see that the carbon fibers prepared from the acrylic fiber precursors within the scope of the present invention have excellent performance.

COMPARATIVE EXAMPLE

Acrylic fiber precursors and carbon fibers were produced as described in Example 1, except that the following compounds were used as oiling agents: (1) polyoxyethylene polysiloxane with a viscosity of 148 poises at 25° C., of the same structure as that of the polysiloxane compound used in Exmaple 1, except that the —$R_9$—A in formula (I) was replaced by —$CH_3$; (2) aminopolysiloxane with a viscosity of 130 poises at 25° C., of the same structure as that of the polysiloxane compound used in Exmaple 1, except that the (B) in formual (I) was replaced by —$CH_3$; and (3) a combination of compounds (1) and (2) with a polyoxyethylene content of 12% based on the total amount of compounds (1) and (2). The properties of the acrylic fiber precursors and the carbon fibers prepared therefrom are shown in Table 2. The acrylic fiber precursors had performances equivalent to those of the samples prepared in Example 1 in accrodance with the present invention, but the carbon fibers prepared from these precursors had lower tensile strengths because of the penetration of the oiling agents into the fibers and the coaleascence of individual filaments that occurred during the preoxidation and carbonization steps.

TABLE 1

Performance of Acrylic Fiber Precursors and Carbon Fibers

| | Performance of acrylic fiber precursors | | | | | Performance of carbon fibers | | | | |
|---|---|---|---|---|---|---|---|---|---|---|
| Run No. | Content of polyoxyethylene group (%) | Deposition amount of oiling agent (%) | Dry tensile strength (g/d) | Dry elongation (%) | Coalescence of filaments | Tensile Strength (kg/mm$^2$) | Modulus of elasticity ($10^3$ kg/mm$^2$) | Elongation (%) | Number of coalescence (blocks)* | Number of coalescence (blocks)** |
| 1 | 3 | 0.08 | 7.5 | 8.5 | substantially zero | 470 | 25.8 | 1.82 | 30 | 20,100 |
| 2 | 8 | 0.10 | 7.5 | 8.4 | substantially zero | 513 | 26.0 | 1.97 | 12 | 10,14 |
| 3 | 12 | 0.11 | 7.6 | 8.5 | substantially zero | 525 | 25.9 | 2.03 | 20 | 10,23 |
| 4 | 20 | 0.12 | 7.4 | 8.6 | substantially zero | 450 | 26.1 | 1.72 | 28 | 25,32 |

*Measured as in Example 1.
**Minimum and maximum numbers of coalesed blocks in 10 samples taken at 5-cm intervals in a 50-cm long strand.

TABLE 2

Perfromance of Acrylic Fiber Precursors and Carbon Fibers

| | | Performance of acrylic fiber precursors | | | | Performance of carbon filbers | | | | |
|---|---|---|---|---|---|---|---|---|---|---|
| Run No. | Oiling agent | Deposition amount of oiling agent (%) | Dry tensile strength (g/d) | Dry elongation (%) | Coalescence of filaments | Tensile Strength (kg/mm$^2$) | Modulus of elasticity ($10^3$ kg/mm$^2$) | Elongation (%) | Number of coalescence (blocks)* | Number of coalescence (blocks)** |
| 5 | polyoxyethylene polysiloxane | 0.12 | 7.4 | 8.7 | substantially zero | 453 | 30.2 | 1.50 | 12 | 10,15 |
| 6 | amino-polysiloxane | 0.09 | 7.5 | 8.4 | few | 475 | 30.0 | 1.58 | 83 | 80,95 |
| 7 | mixture of polyoxyethylene polysiloxane and aminopolysiloxane | 0.10 | 7.5 | 8.6 | substantially zero | 488 | 30.0 | 1.63 | 65 | 60,70 |

*, **See the notes for Table 1.

EXAMPLE 3

Acrylic fiber precursor strands and carbon fiber strands were produced in the same manner as described in Example 1 except that oiling agents (1), (2), (3) and (4) comprising polyoxyethylene aminopolysiloxane used in Example 1 and a quaternary ammonium phosphate of (II)-4 in mixture ratios of 1/2, 1/1, 2/1 and 0/1 (by weight, respectively, were used.

Properties of the acrylic fiber precursor and carbon fibers obtained are shown in Table 3.

In Table 3 it can be seen that by using a conventional aliphatic quaternaly ammonium salt as an oiling agent in convination with a polyoxyalkylene aminopolysiloxane of the present invention coalescence of a acrylic fiber strand can be prevented, and furthermore properties of the carbon fiber strands can also be more improved.

TABLE 3

| | | Performance of Acrylic Fiber Precursors and Carbon Fibers | | | | | | | |
|---|---|---|---|---|---|---|---|---|---|
| | | Performance of acrylic fiber precursors | | | | Performance of carbon filbers | | | |
| Run No. | Oiling agent | Deposition amount of oiling agent (%) | Dry tensile strength (g/d) | Dry elongation (%) | Coalescence of filaments | Tensile Strength (kg/mm$^2$) | Modulus of elasticity ($10^3$ kg/mm$^2$) | Elongation (%) | Number of coalescence (blocks)* |
| 8 | (1) | 0.10 | 7.5 | 8.7 | substantially zero | 524 | 30.0 | 1.75 | 32 |
| 9 | (2) | 0.11 | 7.6 | 8.5 | substantially zero | 545 | 30.0 | 1.82 | 21 |
| 10 | (3) | 0.10 | 7.6 | 8.5 | substantially zero | 560 | 30.3 | 1.85 | 15 |
| 11 | (4) | 0.11 | 7.6 | | few | 480 | 29.9 | 1.61 | 40 |

*See the notes for Table 1.

While the invention has been described in detail and with reference to specific embodiments thereof, it will be apparent to one skilled in the art that various changes and modifications can be made therein without departing from the spirit and the scope thereof.

What is claimed is:

1. An acrylic fiber having applied thereto a polyoxyalkylene aminopolysiloxane compound having a viscosity of from 5 to 500 poises at 25° C. and which is represented by formula (I) as an oiling agent:

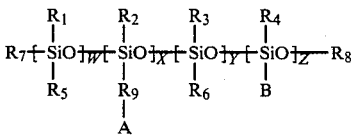

(I)

wherein $R_1$, $R_2$, $R_3$, $R_4$, $R_5$ and $R_6$ each represents a lower alkyl group or an aryl group, $R_7$ represents a hydrogen atom, a lower alkyl group or an aryl group, $R_8$ represents H or —$CH_3$, or

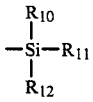

(wherein $R_{10}$, $R_{11}$ and $R_{12}$ each represents a hydrogen atom, a lower alkyl group or an aryl group), $R_9$ represents an alkylene group having not more than 5 carbon atoms, an arylene group, or a single bond, A represents a group

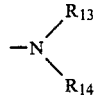

(wherein $R_{13}$ and $R_{14}$ each represents H, —$CH_3$, —$C_2H_5$), B represents a group —$(CH_2CH_2O)m(CH_2CH_3CHO)nR_{15}$ (wherein $R_{15}$: H or —$CH_3$), and m and n each represents ) or an integer of from 1 to 10, provided that $m+n \geqq 1$, X and Z each represents an integer from 1 or more, and W and Y each represents 0 or an integer of 2 or more, wherein the polyoxyalkylene group (B) in formula (I) comprises from 5 to 15% by weight based on the weight of said polyoxyalkylene aminopolysiloxane compound, and wherein the amino group (A) in formula (I) is 0.5–1.5% by weight based on the weight of said polyoxyalkylene aminopolysiloxane compound.

2. An acrylic fiber as in claim 1, wherein the amount of said oiling agent is at least 0.01% by weight based on the weight of the fiber having the compound.

3. An acrylic fiber as in claim 1, wherein the amount of said oiling agent is from 0.05 to 10% by weight based on the weight of the fiber having the compound.

4. An acrylic fiber as in claim 1, wherein the lower alkyl group has from 1 to 4 carbon atoms.

5. An acrylic fiber as in claim 1, wherein the alkyl group is selected from the group consisting of a methyl group and an ethyl group.

6. An acrylic fiber as in claim 1, wherein the aryl group is a phenyl group.

7. An acrylic fiber as in claim 1, wherein the arylene group is a phenylene group.

8. An acrylic fiber as in claim 1, wherein the sum of m and n is not more than 10.

9. An acrylic fiber as in claim 1, wherein the acrylic fiber is obtained from an acrylonitrile homopolymer or a copolymer containing not less than 90% by weight of acrylonitrile.

10. An acrylic fiber as in claim 1, wherein the acrylic fiber has a filament fineness of from 0.1 to 2 deniers.

11. An acrylic fiber as in claim 1, wherein an oiling agent selected from the compounds represented by formula (II), (III) or (IV) is used in combination with the compound represented by formula (I);

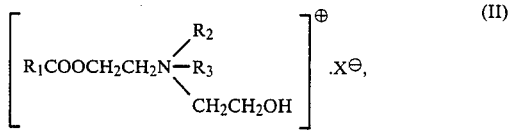

(II)

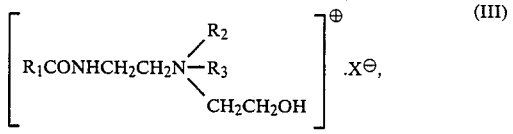

(III)

wherein $R_1$ represents an aliphatic hydrocarbon group having from 11 to 17 carbon atoms; $R_2$ and $R_3$ each represents a hydrogen atom, a lower alkyl group, hydroxyethyl or hydroxyisopropyl group; and X represents an anion;

$$C_nH_{2n+1}COO(CH_2CH_2O)_pH \quad \text{(IV)}$$

wherein n represents a number of from 9 to 18 and p represents a number of from 10 to 50.

12. An acrylic fiber as in claim 1, wherein the fiber consists of a strand having 500 to 100,000 filaments.

13. A method for applying a polyoxyalkylene aminopolysiloxane compound as an oiling agent to an acrylic fiber, which comprises applying the oiling agent to the fiber during the production of the fiber; said compound has a viscosity of from 5 to 500 poises at 25° C. and which is represented by formula (I):

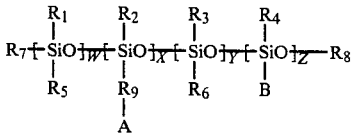

(I)

wherein $R_1$, $R_2$, $R_3$, $R_4$, $R_5$ and $R_6$ each represents a lower alkyl group or an aryl group, $R_7$ represents a hydrogen atom, a lower alkyl group or an aryl group, $R_8$ represents H or $-CH_3$, or

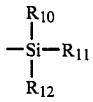

(wherein $R_{10}$, $R_{11}$ and $R_{12}$ each represents a hydrogen atom, a lower alkyl group or an aryl group), $R_9$ represents an alkylene group having not more than 5 carbon atoms, an arylene group, or a single bond, A represents a group

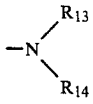

(wherein $R_{13}$ and $R_{14}$ each represents H, $-CH_3$, $-C_2H_5$),

B represents a group $-(CH_2CH_2O)m(CH_2CH_3CHO)nR_{15}$ (wherein $R_{15}$: H or $-CG_3$), and m and n each represents 0 or an integer of from 1 to 10, provided that $m+n \geqq 1$, X and Z each represents an integer from 1 or more, and W and Y each represents 0 or an integer of 1 or more, wherein the polyoxyalkylene group (B) in formula (I) comprises from 5 to 15% by weight based on the weight of said polyoxyalkylene aminopolysiloxane compound, and wherein the amino group (A) in formula (I) is 0.5–1.5% by weight based on the weight of said polyoxyalkylene aminopolysiloxane compound.

14. A method as in claim 13, wherein the oiling agent is applied after extruding a solution of an acrylonitrile homopolymer or copolymer into a coagulation bath and removing the solvent.

15. A method as in claim 13, wherein the oiling agent is applied after extruding a solution of an acrylonitrile homopolymer or copolymer into a coagulation bath, removing the solvent, and drying to increase the density of fiber.

16. A method as in claim 13, wherein the oiling agent is applied to the fiber by immersing the fiber in a solution or dispersion of the oiling agent.

17. A method as in claim 13, wherein the oiling agent is applied to the fiber by spraying a solution or dispersion of the oiling agent.

18. A process for producing preoxidized fiber by preoxidizing the acrylic fiber of claim 1.

19. Preoxidized fiber produced according to the process as claimed in claim 18.

20. A process for producing carbon fiber by carbonizing the preoxidized fiber produced according to the process as claimed in claim 19.

21. Carbon fiber produced according to the process as claimed in claim 20.

22. A method as in claim 13, wherein the oiling agent is applied after extruding a solution of an acrylonitrile homopolymer or copolymer into a coagulation bath and removing the solvent, and then the thus obtained filaments are dried at from 70° to 90° C. until the moisture content of the filaments is reduced to from 5 to 10% by weight based on the weight of the filaments, whereafter the filaments are further dried to obtain acrylic fibers.

23. A method as in claim 22, wherein the drying at 70° to 90° C. is conducted for from 30 to 120 seconds.

24. A method as in claim 22, wherein the filaments are further dried at from 120° to 140° C.

25. A method as in claim 24, wherein the filaments are further dried to attain a moisture content of not more than 1% by weight.

26. A method as in claim 13, wherein the amount of said oiling agent is at least 0.01% by weight based on the weight of the fiber having the compound.

27. A method as in claim 13, wherein the amount of said oiling agent is from 0.05 to 10% by weight based on the weight of the fiber having the compound.

28. A method as in claim 13, wherein an oiling agent selected from the compounds represented by formula (II), (III) or (IV) is used in combination with the compound represented by formfula (I):

$$\left[R_1COOCH_2CH_2N(R_2)(R_3)(CH_2CH_2OH)\right]^{\oplus}.X^{\ominus}, \quad \text{(II)}$$

-continued $$\left[R_1CONHCH_2CH_2N(R_2)(R_3)(CH_2CH_2OH)\right]^{\oplus}.X^{\ominus}, \quad \text{(III)}$$

wherein $R_1$ represents an aliphatic hydrocarbon group having from 11 to 17 carbon atoms; $R_2$ and $R_3$ each represents a hydrogen atom, a lower alkyl group; and X represents an anion;

$$C_nH_{2n+1}COO(CH_2CH_2O)pH \quad \text{(IV)}$$

wherein n represents a number of from 9 to 18 and p represents a number of from 10 to 50.

29. A method as in claim 13, wherein the fiber consists of a strand having 500 to 100,000 filaments.

* * * * *